US010369609B2

(12) United States Patent
DiPierdomenico et al.

(10) Patent No.: US 10,369,609 B2
(45) Date of Patent: Aug. 6, 2019

(54) ROLLER WITH COMPOUND ANGLE FLANGE

(71) Applicant: Victaulic Company, Easton, PA (US)

(72) Inventors: Louis A. DiPierdomenico, Forks Township, PA (US); Paulina A. Olesinska, Easton, PA (US); Douglas R. Dole, White House Station, NJ (US)

(73) Assignee: Victaulic Company, Easton, PA (US)

( * ) Notice: Subject to any disclaimer, the term of this patent is extended or adjusted under 35 U.S.C. 154(b) by 696 days.

(21) Appl. No.: 14/811,889

(22) Filed: Jul. 29, 2015

(65) Prior Publication Data

US 2016/0059287 A1 Mar. 3, 2016

Related U.S. Application Data

(60) Provisional application No. 62/043,956, filed on Aug. 29, 2014.

(51) Int. Cl.

| | |
|---|---|
| ***B21B 27/02*** | (2006.01) |
| ***B21B 27/00*** | (2006.01) |
| ***B21D 17/04*** | (2006.01) |
| *B21D 41/00* | (2006.01) |
| *B21D 15/06* | (2006.01) |
| *B21D 39/04* | (2006.01) |

(52) U.S. Cl.

CPC ..... *B21D 17/04* (2013.01); *B21B 27/005* (2013.01); *B21D 15/06* (2013.01); *B21D 39/046* (2013.01); *B21D 41/00* (2013.01)

(58) Field of Classification Search

CPC ... B21B 2023/005; B21B 23/00; B21D 17/04; B21D 15/06; B21D 22/16; B21D 39/046; B21D 41/00; B21D 41/023

See application file for complete search history.

(56) References Cited

U.S. PATENT DOCUMENTS

| | | | |
|---|---|---|---|
| 3,903,722 | A | 9/1975 | Thau, Jr. et al. |
| 3,995,466 | A | 12/1976 | Kunsman |

(Continued)

FOREIGN PATENT DOCUMENTS

| | | |
|---|---|---|
| CN | 1049618 | 3/1991 |
| CN | 201320553 | 10/2009 |
| JP | 2008229726 A | 10/2008 |

OTHER PUBLICATIONS

Copenheaver, Blaine; International Search Report from corresponding International patent application No. PCT/US2015/03740; dated Oct. 16, 2015; pp. 1-2; United States Patent and Trademark Office as Searching Authority; Alexandria, Virginia USA.

(Continued)

*Primary Examiner* — Peter Dungba Vo
*Assistant Examiner* — Joshua D Anderson
(74) *Attorney, Agent, or Firm* — Ballard Spahr LLP

(57) ABSTRACT

An inner roller used for roll forming pipe elements has a flange extending radially from a body. The flange has a surface divided into annular surface portions. The surface portions have orientation angles measured relatively to the axis of rotation of the inner roller. The orientation angles of surface portions farther from the body have greater orientation angles than the surface portions nearer to the body to mitigate adverse frictional effects between the pipe element and the flange during roll forming.

33 Claims, 9 Drawing Sheets

(56) References Cited

U.S. PATENT DOCUMENTS

| | | | | |
|---|---|---|---|---|
| 5,246,256 | A * | 9/1993 | Rung | F16L 9/02 285/112 |
| 5,279,143 | A | 1/1994 | Dole | |
| 5,570,603 | A | 11/1996 | Chatterley et al. | |
| 6,196,039 | B1 * | 3/2001 | Williams | B21D 17/04 72/105 |
| 6,968,720 | B2 | 11/2005 | Balagna et al. | |
| 8,550,502 | B2 * | 10/2013 | Vandal | F16L 17/04 285/112 |
| 8,777,277 | B2 | 7/2014 | Dole et al. | |
| 2012/0280494 | A1 * | 11/2012 | Vandal | F16L 17/04 285/337 |
| 2013/0055780 | A1 | 3/2013 | Novitsky et al. | |

OTHER PUBLICATIONS

Copenheaver, Blaine; Written Opinion from corresponding International patent application No. PCT/US2015/03740; dated Oct. 16, 2015; pp. 1-5; United States Patent and Trademark Office as Searching Authority; Alexandria, Virginia USA.

Author Unknown; Gruvlok 3006/3006C Roll Groover Manual; Jul. 2009; Anvil International.

* cited by examiner

ROLLER WITH COMPOUND ANGLE FLANGE

CROSS REFERENCE TO RELATED APPLICATION

This application is based upon and claims priority to U.S. Provisional Application No. 62/043,956 filed Aug. 29, 2014 and hereby incorporated by reference.

FIELD OF THE INVENTION

This invention relates to rollers for roll forming pipe elements.

BACKGROUND

Circumferential grooves and other features such as shoulders and beads may be formed in pipe elements by various methods, one of particular interest being roll grooving. Roll grooving methods involve engaging an inner roller with an inner surface of a pipe element and an outer roller with an outer surface of the pipe element opposite to the inner roller and incrementally compressing the sidewall of the pipe element between the rollers while rotating at least one of the rollers. Rotation of one roller (often the inner roller) causes relative rotation between the roller set and the pipe element, and features on the inner and outer rollers form corresponding features on the inner and outer surfaces of the pipe element. In one example roll grooving method the rollers remain in a fixed location and the pipe element rotates about its longitudinal axis relative to the rollers. In another example embodiment the pipe element remains stationary and the roller set traverses the pipe element's circumference.

During roll forming of a circumferential groove in a pipe element for example, it is important to maintain the pipe element engaged with the rollers. As disclosed in U.S. Pat. No. 5,279,143 (hereby incorporated by reference) and shown in FIG. 1 herein, it is observed that, for clockwise rotation of the inner roller (when viewed along the line of sight axis defined by arrow 9), if an orientation angle 10 in a vertical plane is maintained between the longitudinal axis 12 of a pipe element 14 and the rotational axis 16 of the inner roller 18, the pipe element 14 will be forced inwardly toward the rollers (to the left in FIG. 1) such that it will abut and remain in contact with a flange 20 extending outwardly from the inner roller 18. Orientation angles 10 of from about 1°-2° provide adequate tracking force to keep the pipe element 14 engaged with the rollers. If the orientation angle 10 reverses, forces on the pipe element 14 reverse and the pipe element will tend to spiral away from the rollers and disengage therefrom.

FIG. 1 shows a side view of the pipe element and rollers, depicting the orientation angle 10 in the vertical plane; there is however a similar tracking issue that is affected by orientation angles in the horizontal plane, shown in FIG. 2. FIG. 2 shows the pipe element 14 (in broken line) and the inner roller 18 from above (the outer roller not shown for clarity). An orientation angle 22 between the longitudinal axis 12 of the pipe element 14 and the rotational axis 16 of the inner roller 18, skewed to the left in the horizontal plane, is also shown. For rotation of the inner roller 18 clockwise (when viewed along the line of sight axis defined by arrow 9), a left skewed orientation angle, if too large (generally in excess of about 2°), has disadvantages, as the pipe may overtrack aggressively toward the flange 20. Aggressive overtracking causes friction between the pipe end and the flange resulting in the pipe material being sheared off the end face of the pipe as the pipe is forced against the flange. In contrast, an orientation angle 22 skewed to the right (shown in FIG. 3) results in a reversal of forces on the pipe element 14 which cause it to spiral out of engagement with the rollers. While an orientation angle of exactly zero (axes 12 and 16 aligned in the horizontal plane, not shown) provides adequate tracking and minimizes contact between the pipe end and the flange (thereby minimizing the adverse effects of friction) it is not always possible to ensure and/or maintain an orientation angle of exactly zero in the horizontal plane. Furthermore, it is advantageous to avoid a right skewed orientation angle (shown in FIG. 3) to prevent pipe element disengagement. Thus, while a left skewed orientation angle may have disadvantages if too large, it is preferred over a right skewed orientation angle, and provides a margin of acceptability against pipe element disengagement over the zero orientation angle. There is clearly a need for an improved inner roller that can mitigate the adverse effects of aggressive tracking so that a broader range of left skewed orientation angles in the horizontal plane may be used to ensure that the pipe element tracks toward the flange and maintains proper engagement with the rollers during roll forming. (Note that for counterclockwise rotation of the inner roller 18 when viewed along line of sight 9, the conditions are reversed and a right skewed orientation angle as shown in FIG. 3 provides the desired tracking of the pipe element toward the flange 20.)

SUMMARY

The invention concerns a roller for roll forming pipe elements. In one example embodiment, the roller comprises a body rotatable about an axis. A flange extends circumferentially about the body and projects radially outwardly therefrom relative to the axis. The flange comprises a surface having at least a first surface portion oriented angularly with respect to the axis at a first orientation angle, and a second surface portion oriented angularly with respect to the axis at a second orientation angle.

In a particular embodiment, the body is substantially cylindrical in shape, the axis being co-axial with a longitudinal axis thereof. By way of example, the flange may have a circular perimeter. In one example, the first and second surface portions are contiguous with one another. In a particular example the first and second surface portions have an annular shape. By way of example, the first surface portion may be positioned closer to the body than the second surface portion. In a particular example, the first orientation angle is from about 91° to about 93°, and may be about 92°. By way of further example, the second orientation angle may be from about 93° to about 96°, and may be about 95°.

In another example embodiment, the flange comprises a third surface portion positioned closer to the body than the first surface portion. The third surface portion may have an orientation angle of about 90° relatively to the axis.

In a specific example embodiment, the body comprises an outer surface having plurality of raised features extending outwardly therefrom. The raised features may comprise a cylindrical surface or a conical surface. By way of example, at least two of the raised features may extend circumferentially about the body, positioned in spaced apart relation to one another along the axis. The raised features may comprise knurled surfaces facing radially outwardly relative to the axis. The invention also encompasses an apparatus for roll forming pipe elements using a roller as described above.

In another example embodiment of a roller for roll forming pipe elements, the roller comprises a body rotatable about an axis. A flange extends circumferentially about the body and projects radially outwardly therefrom relative to the axis. The flange comprises a curved surface having a center of curvature such that the curved surface retreats away from a line perpendicular to the axis.

DETAILED DESCRIPTION

Figure 1:
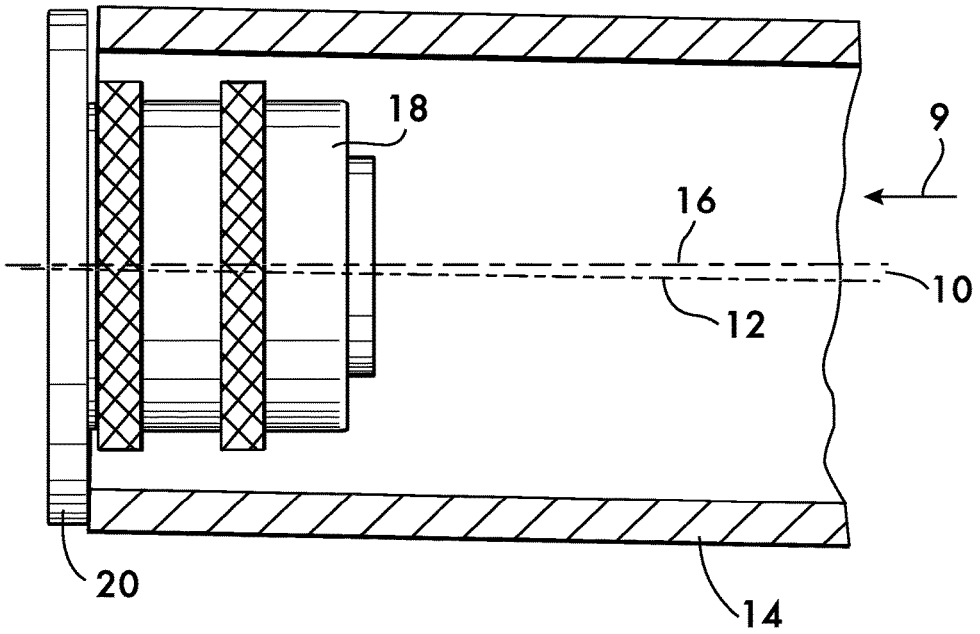
FIG. 1 PRIOR ART
FIG. 1 is a partial sectional side view of a roller for roll forming pipe elements according to the prior art.
Figure 2:
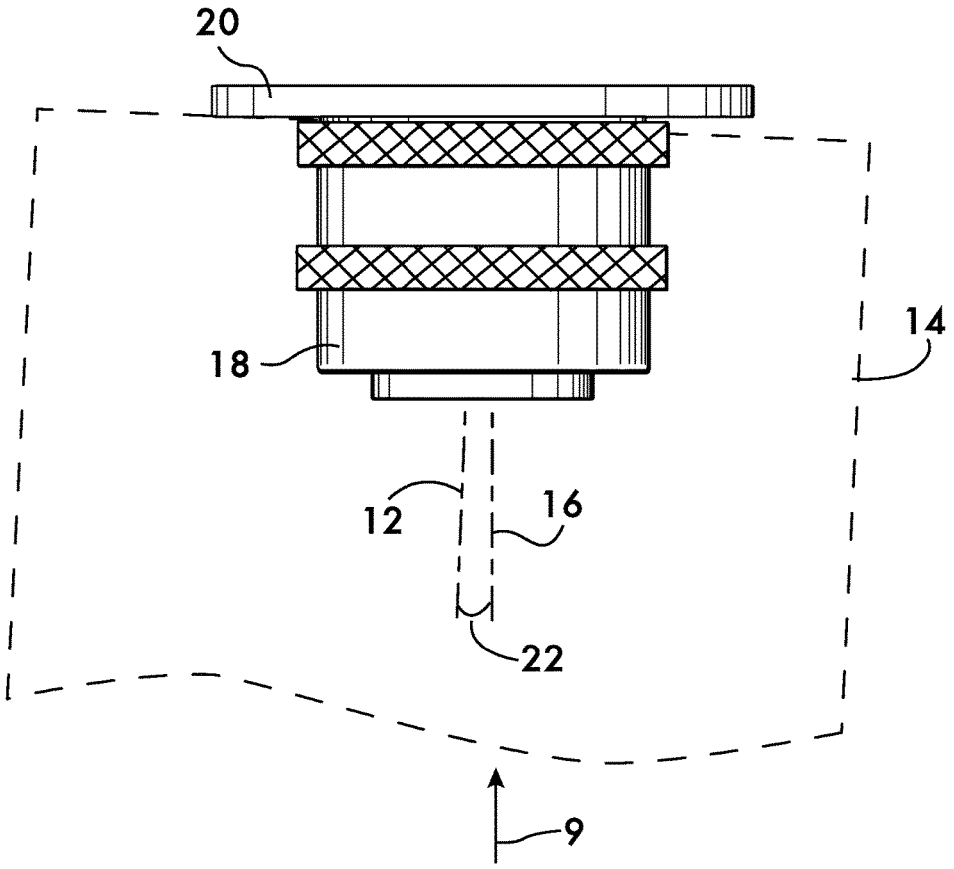
FIG. 2 PRIOR ART
FIGS. 2 and 3 are partial top views of a roller for roll forming pipe elements according to the prior art.
Figure 3:
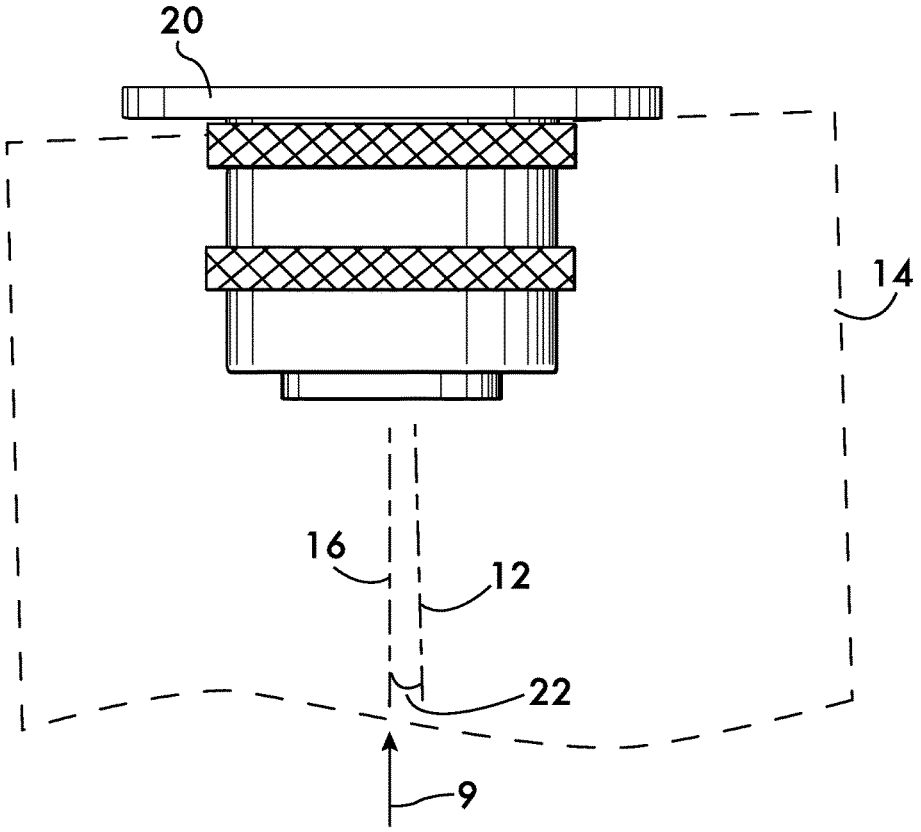
FIG. 3 PRIOR ART
Figure 4:
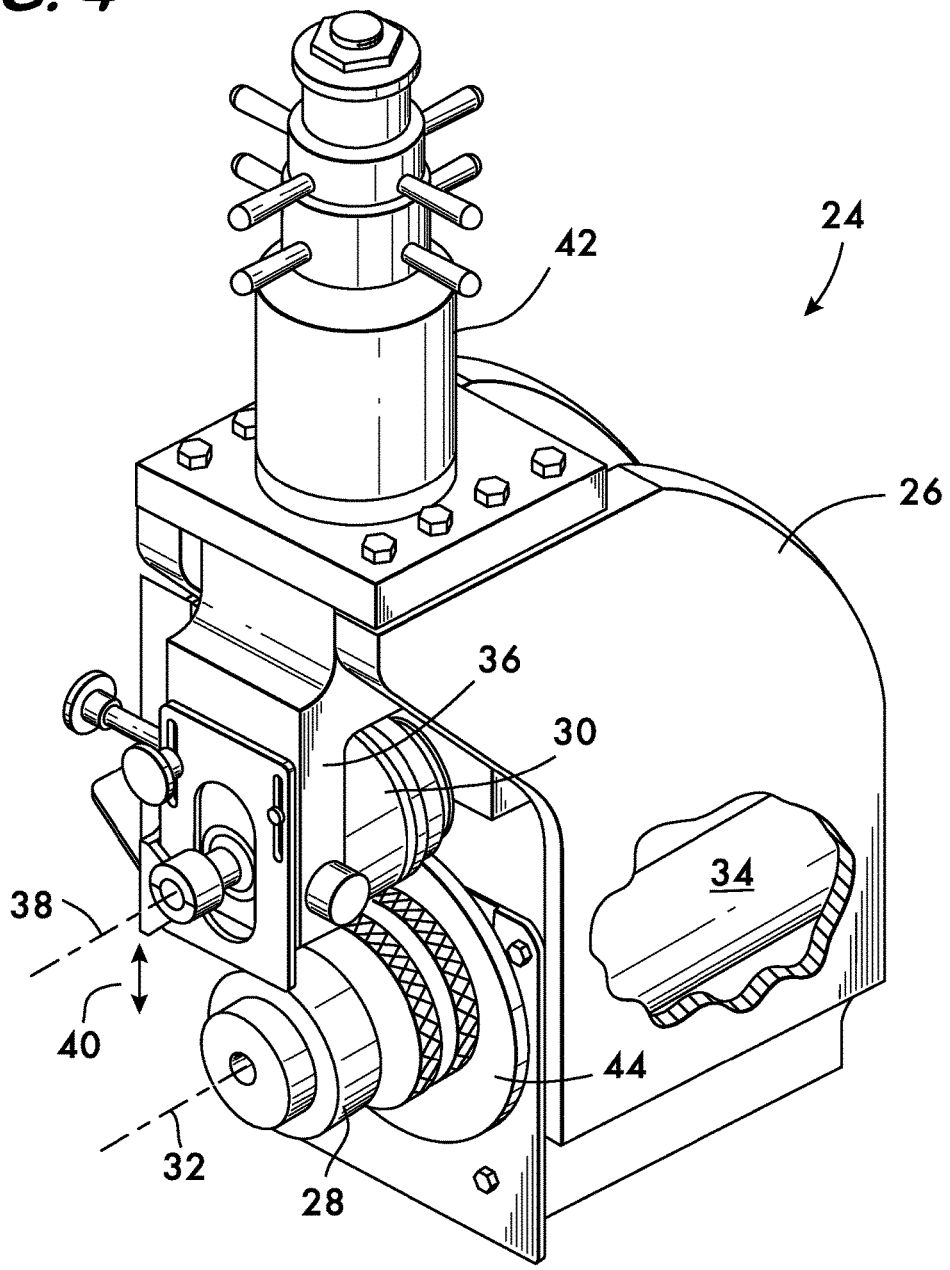
FIG. 4 is an isometric view of an example apparatus for roll forming pipe elements using rollers according to the present invention.

FIG. 4 shows an apparatus 24 for roll forming pipe elements, apparatus 24 comprising a housing 26 on which an inner roller 28 according to the invention, and an outer roller 30, are rotatably mounted. Inner roller 28 rotates about rotation axis 32, in this example driven by electrical motor 34. Outer roller 30 is an idler and is mounted on a yoke 36 for rotation about an axis 38, preferably oriented substantially parallel (in both the horizontal and vertical planes) to axis 32 of the inner roller 28. Yoke 36 is movable toward and away from inner roller 28 as illustrated by arrow 40, in this example by a hydraulic actuator 42.

Figure 5:
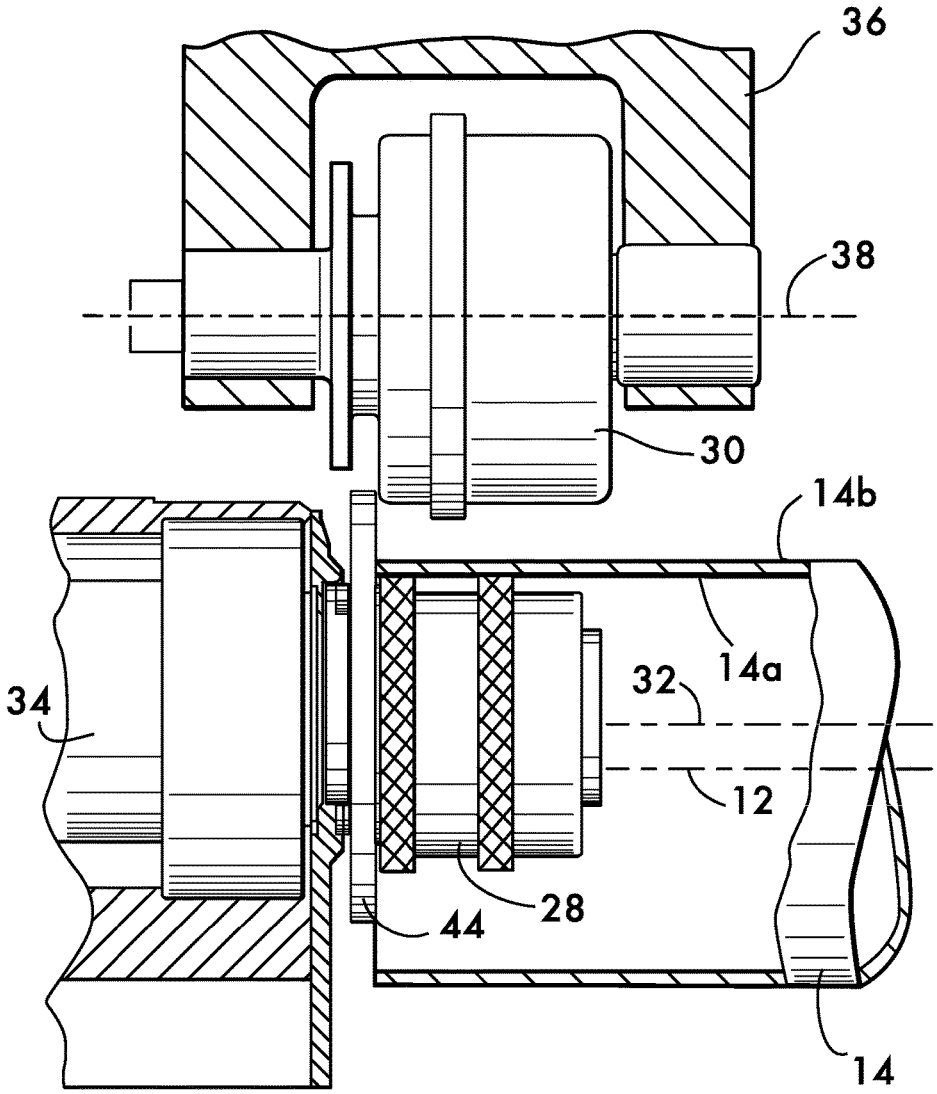
FIGS. 5 and 6 are partial sectional side view of example rollers for roll forming pipe elements according to the invention.
Figure 6:
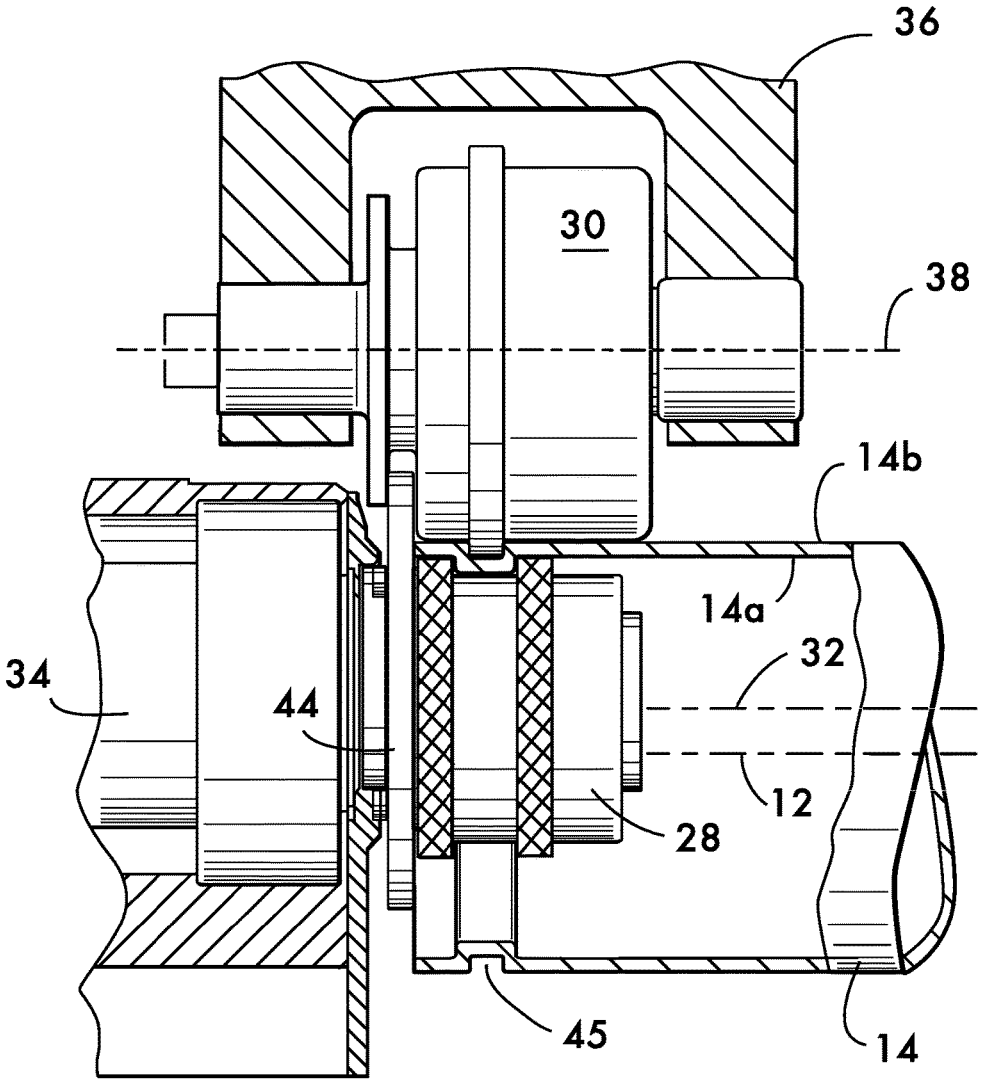

In operation, as shown in FIG. 5, the inner surface 14*a* of pipe element 14 is engaged with the inner roller 28, the end of the pipe element preferably engaging the inner roller's flange 44. As shown in FIGS. 4 and 6, hydraulic actuator 42 moves the outer roller 30 into engagement with the outer surface 14*b* of pipe element 14. Motor 34 rotates the inner roller 28 about axis 32 while the actuator 42 forces the outer roller 30 against the outer surface 14*b* of the pipe element 14, thereby roll forming a circumferential groove 45 in the pipe element, the outer roller 30 rotating about its axis 38 as an idler and the pipe element 14 rotating about its longitudinal axis 12.

Figure 7:
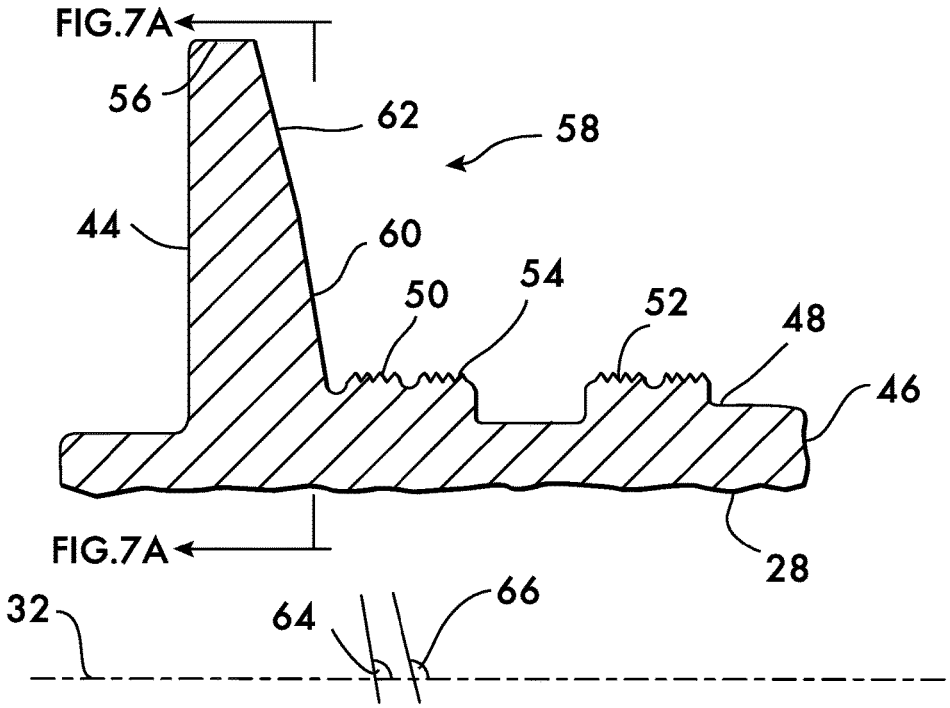
FIGS. 7, 8, 9 and 10 are partial longitudinal sectional views of example rollers according to the invention.
Figure 8:
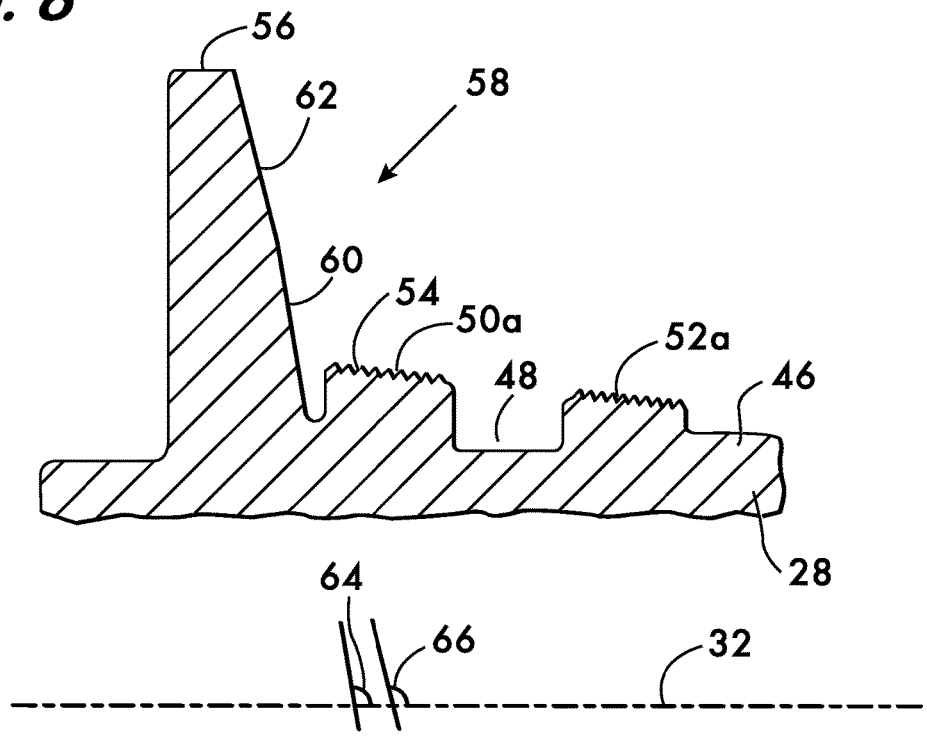

FIGS. 7 and 8 show partial sectional views of an example embodiment of an inner roller 28 according to the invention. Inner roller 28 comprises a body 46 rotatable about axis 32, body 46 being substantially cylindrical in cross section with the axis 32 being substantially coaxial with the body longitudinal axis. As shown in FIG. 7, body 46 has an outer surface 48 with two raised features 50 and 52 extending outwardly therefrom. The raised features 50 and 52 are positioned in spaced relation to one another along axis 32. Raised features 50 and 52 may have knurled surfaces 54 facing radially outwardly relative to the axis 32. The knurled surfaces 54 provide purchase and mitigate slipping between the inner surface 14*a* of the pipe element 14 and the inner, driven roller 28. In the embodiment shown in FIG. 7 the raised features 50 and 52 describe a cylindrical surface. In contrast, in the embodiment shown in FIG. 8, the raised features 50*a* and 52*a* are conical and lie in a common conical surface.

Figure 7A:
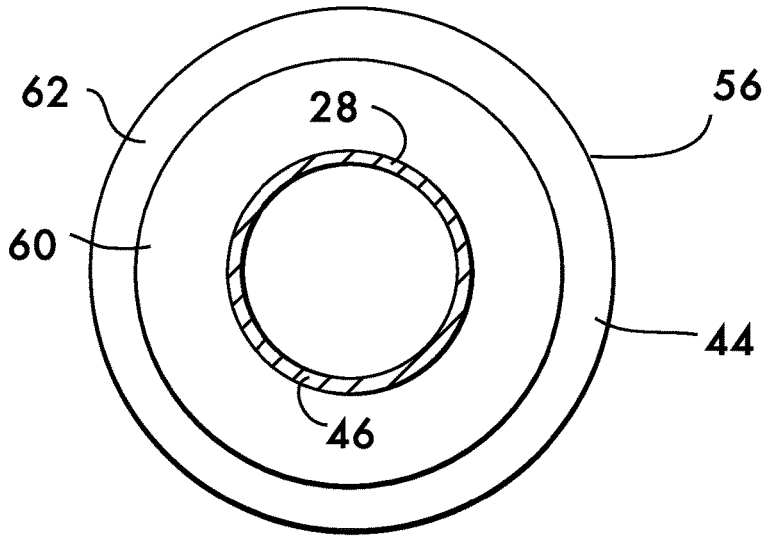
FIGS. 7A and 9A are partial cross sectional views of example rollers according to the invention.

Flange 44 shown in FIGS. 7 and 8 has a perimeter 56 and extends circumferentially about body 46. Perimeter 56 may be circular by way of example. The flange 44 projects radially outwardly from body 46 relative to axis 32. Flange 44 comprises a surface 58 having a first surface portion 60 and a second surface portion 62. In this example the first and second surface portions 60 and 62 are contiguous with one another, with the first surface portion 60 being positioned closer to the body 46 than the second surface portion 62. As shown in FIG. 7A, the first and second surface portions 60 and 62 have an annular shape. With reference again to FIGS. 7 and 8, first surface portion 60 is angularly oriented relatively to axis 32, having an orientation angle 64 which may range from about 91° to about 93°. An orientation angle 64 of about 92° is expected to be advantageous. Second surface portion 62 is also angularly oriented with respect to axis 32 and has an orientation angle 66 greater than angle 64. Orientation angles 66 may range from about 93° to about 96° with an orientation angle of about 95° expected to be advantageous. When the first and second surface portions take an annular form, they may have widths of about 0.18 to about 0.5 inches with 0.375 being thought advantageous. It is found worthwhile to establish the width of the surface portions in relation to the thickness of pipe element to be processed.

Figure 9:
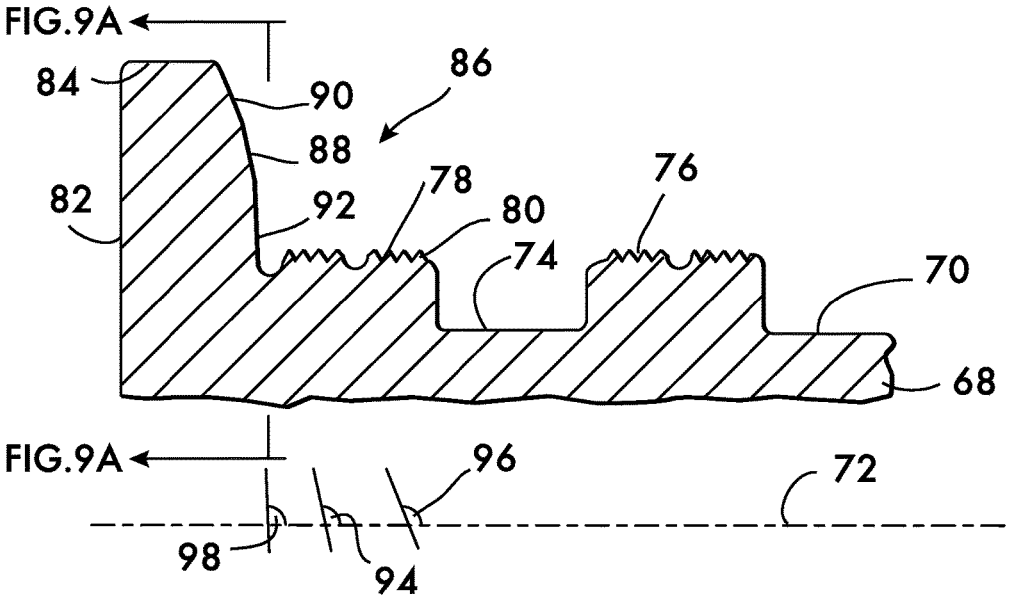

FIG. 9 shows another example embodiment of an inner roller 68 according to the invention. Inner roller 68 comprises a body 70 rotatable about an axis 72, body 70 being substantially cylindrical in shape with the axis 72 being substantially coaxial with the cylinder longitudinal axis. Body 70 has an outer surface 74 with two raised features 76 and 78 extending outwardly therefrom. The raised features 76 and 78 are positioned in spaced relation to one another along axis 72. Raised features 76 and 78 may have knurled surfaces 80 facing radially outwardly relative to the axis 72. The knurled surfaces 80 provide purchase and mitigate slipping between the inner surface of the pipe element 14 and the inner, driven roller 68.

Figure 9A:
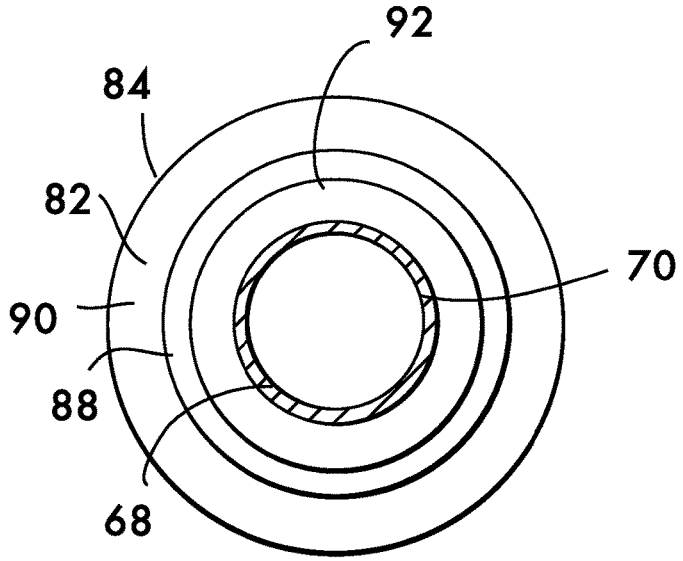

A flange 82 shown in FIG. 9 has a perimeter 84 and extends circumferentially about body 70. Perimeter 84 may be circular by way of example. The flange 82 projects radially outwardly from body 70 relative to axis 72. Flange 82 comprises a surface 86 comprising a first surface portion 88, a second surface portion 90 and a third surface portion 92. The first surface portion 88 is positioned closer to the body 70 than the second surface portion 90. The third surface portion 92 is positioned closer to body 70 than the first surface portion 88. In this example the first and second surface portions 88 and 90 are contiguous with one another, and the first and third surface portions 88 and 92 are contiguous with one another. As shown in FIG. 9A, the first, second and third surface portions 88, 90 and 92 have an annular shape. With reference again to FIG. 9, first surface portion 88 is angularly oriented relatively to axis 72, having an orientation angle 94 which may range from about 91° to about 93°. An orientation angle of about 92° is expected to be advantageous. Second surface portion 90 is also angularly oriented with respect to axis 72 and has an orientation angle 96 greater than angle 94. Orientation angles 96 may range from about 93° to about 96° with an orientation angle of about 95° expected to be advantageous. Third surface portion 92 has an orientation angle 98 of about 90° and may extend radially from the outer surface 74 of body 70 to form an annulus.

Figure 10:
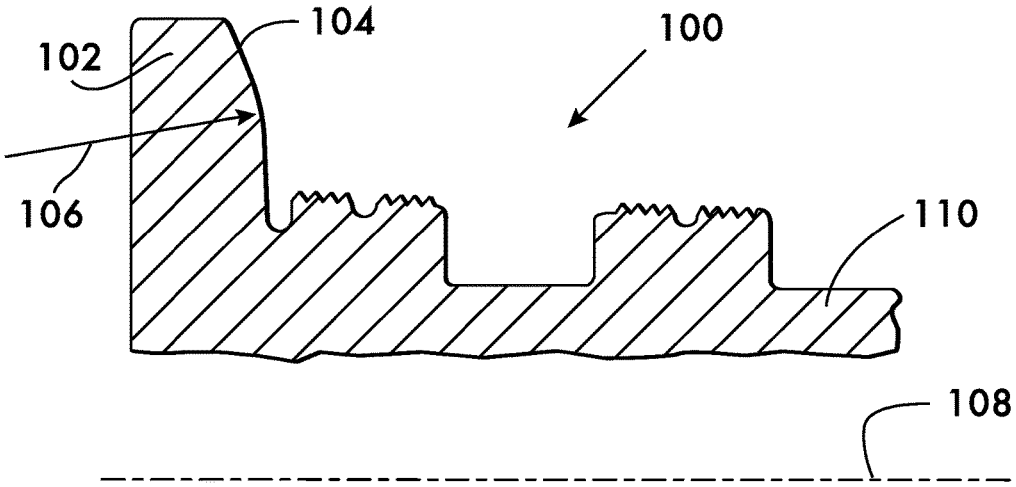

FIG. 10 shows an embodiment of an inner roller 100 wherein the flange 102 has a curved surface 104. Curved surface 104 has a radius of curvature 106 positioned so that the surface 104 retreats away from the end of a pipe element engaged with the inner roller 100 as the surface moves away from the axis of rotation 108 of the body 110 comprising inner roller 100.

It has been found that inner rollers according to the invention permit the use of a broader range of left skewed orientation angles between the longitudinal axis of the pipe element and the rotational axis of the inner roller for clockwise rotation of the inner roller. The orientation angles of the flange surface portions reduce the area of contact between the pipe end and the flange and permit more aggressive tracking to keep the pipe element engaged with the rollers while also mitigating the adverse frictional effects between the pipe end and the flange of the inner roller otherwise associated with overly left skewed orientation angles in a horizontal plane.

What is claimed is:

1. A roller for roll forming pipe elements, said roller comprising:

a body rotatable about an axis;

a flange extending circumferentially about said body and projecting radially outwardly therefrom relative to said axis, said flange comprising a surface having at least a first surface portion oriented angularly with respect to said axis at a first orientation angle, and a second surface portion oriented angularly with respect to said axis at a second orientation angle;

wherein said body comprises an outer surface having at least one raised feature extending radially outwardly therefrom, a border between said first surface portion and said second surface portion positioned radially beyond said at least one raised feature.

2. The roller according to claim 1, wherein said body is substantially cylindrical in shape, said axis being co-axial with a longitudinal axis thereof.

3. The roller according to claim 1, wherein said flange has a circular perimeter.

4. The roller according to claim 1, wherein said first and second surface portions are contiguous with one another.

5. The roller according to claim 4, wherein each of said first and second surface portions has an annular shape.

6. The roller according to claim 1, wherein said first surface portion has an annular shape.

7. The roller according to claim 1, where said second surface portion has an annular shape.

8. The roller according to claim 1, wherein said first surface portion is positioned closer to said body than said second surface portion.

9. The roller according to claim 8, wherein said first orientation angle is from about 91° to about 93°.

10. The roller according to claim 8, wherein said first orientation angle is about 92°.

11. The roller according to claim 8, wherein said second orientation angle is from about 93° to about 96°.

12. The roller according to claim 8, wherein said second orientation angle is about 95°.

13. The roller according to claim 8, wherein said flange comprises a third surface portion positioned closer to said body than said first surface portion, said third surface portion having an orientation angle of about 90° relatively to said axis, a border between said third surface portion and said first surface portion positioned radially beyond said at least one raised feature.

14. The roller according to claim 1, wherein said body comprises an outer surface having a plurality of said raised features extending outwardly therefrom.

15. The roller according to claim 1, wherein said at least one raised feature comprises a cylindrical surface.

16. The roller according to claim 1, wherein said at least one raised feature comprises a conical surface.

17. The roller according to claim 1, comprising two of said raised features extending circumferentially about said body and positioned in spaced apart relation to one another along said axis.

18. The roller according to claim 1, wherein said at least one raised feature comprises a knurled surface facing radially outwardly relative to said axis.

19. An apparatus for roll forming pipe elements using a roller according to claim 1.

20. A roller for roll forming pipe elements, said roller comprising:

a substantially cylindrical body rotatable about an axis coaxial with a longitudinal axis thereof;

a substantially circular flange extending circumferentially about said body and projecting radially outwardly therefrom relative to said axis, said flange comprising a surface having at least a first surface portion oriented angularly with respect to said axis at a first orientation angle, and a second surface portion oriented angularly with respect to said axis at a second orientation angle, said first surface portion being closer to said body than said second surface portion, said first orientation angle being less than said second orientation angle, said first and second surface portions being contiguous with one another; wherein said substantially cylindrical body comprises an outer surface having at least one raised feature extending radially outwardly therefrom, a border between said first surface portion and said second surface portion positioned radially beyond said at least one raised feature.

21. The roller according to claim 20, wherein said first orientation angle is from about 91° to about 93°.

22. The roller according to claim 20, wherein said second orientation angle is from about 93° to about 96°.

23. The roller according to claim 20, wherein said first orientation angle is about 92°.

24. The roller according to claim 20, wherein said second orientation angle is about 95°.

25. The roller according to claim 20, wherein said flange comprises a third surface portion positioned closer to said body than said first surface portion, said third surface portion having an orientation angle of about 90° relatively to said axis, said third surface portion being contiguous with said first surface portion; wherein a border between said third surface portion and said first surface portion positioned radially beyond said at least one raised feature.

26. The roller according to claim 25, wherein each of said first, second and third surface portions has an annular shape.

27. The roller according to claim 20, wherein said first surface portion has an annular shape.

28. The roller according to claim 20, where said second surface portion has an annular shape.

29. The roller according to claim 20, wherein said body comprises an outer surface having plurality of raised features extending outwardly therefrom.

30. The roller according to claim 20, comprising at least two of said raised features extending circumferentially about said body and positioned in spaced apart relation to one another along said axis.

31. The roller according to claim 30, wherein said at least two of said raised features comprise knurled surfaces facing radially outwardly relative to said axis.

32. An apparatus for roll forming pipe elements using a roller according to claim 20.

33. A roller for roll forming pipe elements, said roller comprising:

a body rotatable about an axis;

a flange extending circumferentially about said body and projecting radially outwardly therefrom relative to said axis, said flange comprising a curved surface having a center of curvature such that said curved surface retreats away from an end of one of said pipe elements engaging said flange.

* * * * *